United States Patent [19]

Cervantes

[11] 4,117,455

[45] Sep. 26, 1978

[54] SELF-RIGHTING ROADWAY MARKING DEVICE

[76] Inventor: Lawrence M. Cervantes, 5538 Capellina Way, Santa Barbara, Calif. 93111

[21] Appl. No.: 711,239

[22] Filed: Aug. 3, 1976

[51] Int. Cl.[2] ..... E01F 9/01; G09F 7/22

[52] U.S. Cl. ..... 340/114 R; 40/608; 40/612; 116/63 P

[58] Field of Search ..... 116/63 P; 340/38 R, 340/114 R; 40/125 H, 125 N, 145 A, 130 R, 39

[56] References Cited

U.S. PATENT DOCUMENTS

| | | | |
|---|---|---|---|
| 1,249,539 | 12/1917 | Spear | 116/63 P |
| 1,370,697 | 3/1921 | Mann | 40/145 A |
| 2,002,756 | 5/1935 | Segelhorst | 40/125 N |
| 2,521,496 | 9/1950 | Workun | 116/63 P X |
| 2,646,638 | 7/1953 | Peterson | 116/63 P X |
| 3,318,279 | 5/1967 | Padilla | 116/63 P |

*Primary Examiner*—Daniel M. Yasich

*Attorney, Agent, or Firm*—Spensley, Horn & Lubitz

[57] ABSTRACT

A self-righting tippable roadway marking device includes a base member with a substantially spherical lower ground-engaging surface. A blind bore is formed in the base member centrally thereof and is adapted to releasably retain a staff element fixedly therein. An elongated staff element has its lower portion mounted non-rotatably in the blind bore and has a plurality of wind vane elements secured fixedly thereto. The wind vane elements extend radially outwardly from the staff element and are spaced equidistantly thereabout. Thus, in response to wind or other forces, the marking device will exhibit a tipping and rotating movement on its spherical lower surface.

6 Claims, 5 Drawing Figures

SELF-RIGHTING ROADWAY MARKING DEVICE

BACKGROUND OF THE INVENTION

The present invention relates to self-righting roadway marking devices.

It has been known heretofore to construct roadway marking devices in such manner that they will right themselves upon being struck by a vehicle. Such devices also have been known to employ flags. Typical of such prior constructions is the self-righting roadway warning flag disclosed in U.S. Pat. No. 2,521,496 issued Sept. 5, 1950 to J. P. Worhun. However, the flag in the Worhun patent is carried by a standard which is rotatably mounted in the base. Thus, the flag always aligns itself with the wind so as not to exert an unbalancing force on the base which will cause tipping. This overlooks an important function of the device and fails to capitalize upon wind forces to enhance the value of the device. Rather, such prior devices have been designed to adjust to the wind forces even to the extent of necessitating a more complex structure for the rotatable mounting of the flag-carrying standard.

SUMMARY OF THE INVENTION

It is one object of the invention to provide a self-righting roadway marker which employs wind forces whenever possible to create tipping and rotative forces on the device to enhance its visibility.

It is another object of the invention to provide a self-righting roadway marker which is of extremely simple construction and affords excellent visibility by day or night.

Other objects and advantages of the invention will become readily apparent from the following description of the invention.

According to the present invention there is provided a self-righting rotatable roadway marking device comprising in combination: a base member having a substantially spherical lower ground-engaging surface; a blind bore formed in the base centrally thereof adapted to releasably and fixedly retain the lower portion of a staff element therein; an elongated staff element adapted to be releasably and non-rotatably mounted in the bore; and a plurality of wind vanes secured fixedly to the staff element and extending radially outwardly therefrom in equidistantly spaced relation thereabout.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
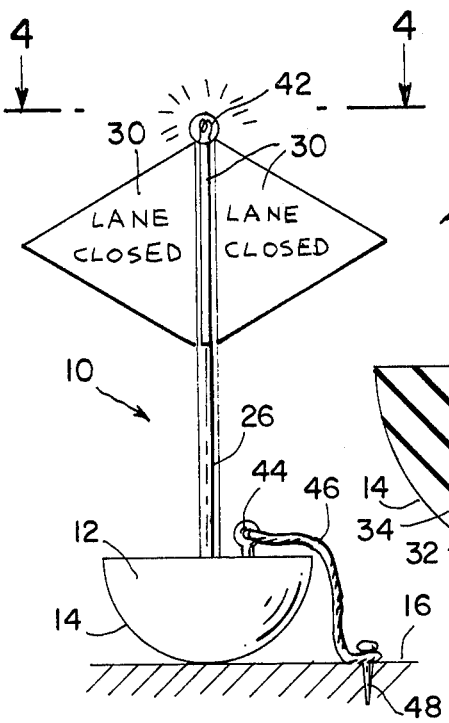
FIG. 1 is an elevational view of a roadway marking device embodying the features of the invention.

Referring to the drawings there is shown a roadway marking device 10. The device includes a base member 12, preferably formed of an elastomeric material which is given a substantially spherical lower ground-engaging surface 14. The provision of such a surface enables the device to right itself when struck by a vehicle or when pivoted as a result of the effect of wind forces impinging upon the wind vane elements to be subsequently described. Further, since there is minimal surface-to-surface contact between the base and the ground 16, the wind forces also tend to effect some degree of rotation of the device which enhances the visibility of the device and thus its general effectiveness as a warning signal to motorists.

The base is provided with a blind bore 18 which is located centrally thereof. The lower extremity of the bore may desirably terminate in an enlarged cavity 20 and a balance weight 22 such as a steel ball may be positioned within such cavity to serve as a counterweight to counteract the effect of wind forces. The blind bore is preferably threaded as at 24 so as to releasably retain the lower portion of a staff element 26 non-rotatably therein. Staff element 26 is elongated and preferably of tubular construction. It may be hollow and is given a threaded section 28 at its lower end which is cooperable with the threads of the bore.

Figure 3:
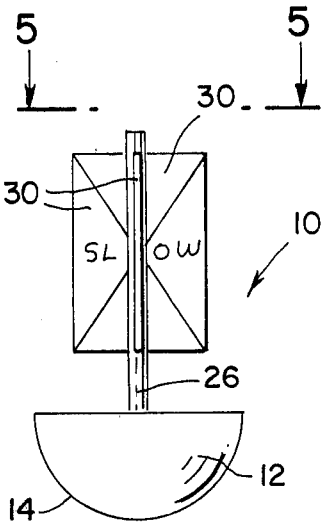
FIG. 3 is a view similar to that of FIG. 1 of a modified form of roadway marking device in accordance with the invention.
Figure 4:
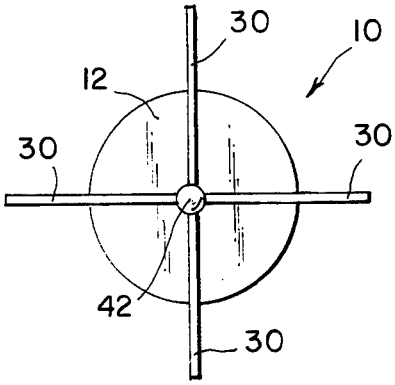
FIG. 4 is a top plan view of the roadway marking device shown in FIG. 1 looking in the direction of line 4—4.
Figure 5:
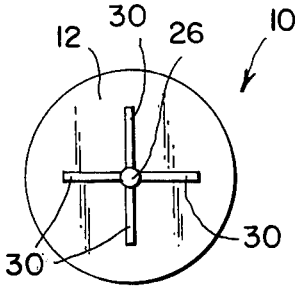
FIG. 5 is a view similar to that of FIG. 4 of the roadway marking device shown in FIG. 3 looking in the direction of line 5—5.

A plurality of wind vane elements 30 are fixedly secured to the staff element in equidistantly spaced relation about its periphery. The vane elements may comprise triangular flags as shown in FIG. 1 or they may constitute elongated oblong flags as depicted in FIG. 3. However, due to the fixed mounting of the flag or wind vane elements on the staff element and the non-rotatable mounting of the staff element in the base it will be appreciated that the wind forces which impinge upon the surfaces of the flags are converted into rotative and tipping forces. The consequent rotation and tipping or rocking of the device has the effect of making the device more noticeable to passing motorists. Each of the vane or flag elements may have a luminous or light-reflective substance applied thereto to enhance the visibility of the device in the hours of darkness.

Figure 2:
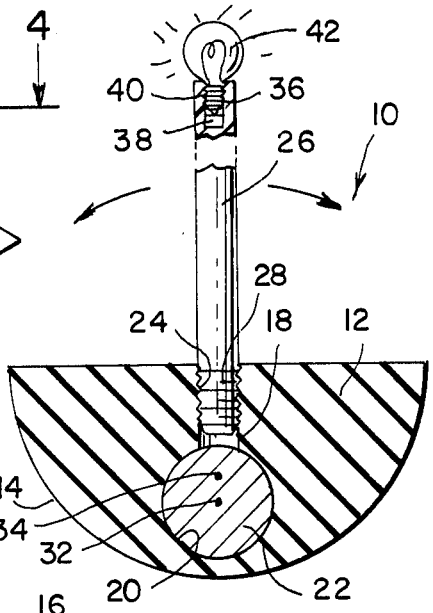
FIG. 2 is an elevational view, partly broken and partly in cross-section, of the roadway marking device shown in FIG. 1.

With respect to the balance weight 22 within the base it will be seen from FIG. 2 that the center of gravity 32 of the balance weight is located below and in vertical alignment with the center of gravity 34 of the base. A restoring moment is thus created tending to right the device once it has been tipped by the wind forces acting upon the wind vane elements 30.

The upper portion of the staff element is provided with a receptacle 36 within which an electric battery 38 is positioned. The receptacle is given a threaded portion 40 for the purpose of receiving a bulb element 42 for operative connection with the battery. A switch, not shown, may be provided for selectively connecting the battery and bulb. Also, as will be appreciated, a flasher may be incorporated in the battery circuit if so desired in order to create a flashing light signal. The pitching and rotation of the base with its superstructure consisting of the staff element and flag elements thus creates a visual warning system which is superior to the relatively stationary road marking devices previously available.

In order to prevent the removal of the device or its displacement from the general area which it is intended to demarcate the base may be given an eye 44 to which a restraining cable 46 may be secured. The cable may be anchored to the ground by means of a spike 48.

From the foregoing it will be seen that by virtue of the wind vane elements fixedly secured to the staff element and the non-rotatable mounting of the staff element in the base a safety device has been provided which is capable of haphazard dynamic display of the flags and/or lights and which thereby affords enhanced visibility to motorists.

I claim:

1. A self-righting, rotatable roadway marking device comprising in combination:

a base member having a curved lower ground-engaging surface causing the base member to be readily tippable;

a blind bore formed in said base member centrally thereof adapted to releasably and fixedly retain the lower portion of a staff element therein;

a balance weight within the base member and in axial alignment with said bore;

the center of gravity of said balance weight being located below the center of gravity of said bore and in vertical alignment therewith;

an elongated staff element releasably and non-rotatably mounted in said bore;

electric battery means and bulb means carried by said staff element and operatively connected to display a lighted signal;

flexible means for loosely maintaining the device to a roadway; and a plurality of stiff wind vanes secured fixedly to said staff element and extending radially outwardly therefrom in equidistantly spaced relation thereabout to cause a tipping and rotating movement of the marking device on its curved lower surface in response to wind forces, the center of gravity of the device being located in relation to the curved surface to produce a restoring movement when the device is tipped, causing the device to be self righting, whereby the marking device exhibits both a tipping and a noticeably rotating movement as a result of wind forces or being struck by a vehicle.

2. A roadway marking device according to claim 1, where there are four of said wind vanes, the wind vanes being secured to said staff element.

3. A roadway marking device according to claim 1, wherein said blind bore and the lower portion of said staff element are threaded to permit threaded engagement of said staff element in said base.

4. A roadway marking device according to claim 1, wherein said base member is formed predominantly of an elastomeric material.

5. A roadway marking device according to claim 1, wherein at least one of said vanes includes a surface material to enhance visability.

6. A roadway marking device according to claim 1, wherein said base member is formed predominantly of an elastomeric material.

* * * * *